US005533728A

United States Patent [19]

Pehoski et al.

[11] Patent Number: 5,533,728

[45] **Date of Patent: *Jul. 9, 1996**

[54] MALLET AND BLADE PUTTER HEADS

[76] Inventors: Richard J. Pehoski, 133 Maplewood Dr., Bolingbrook, Ill. 60440; Joseph A. Pessetti, 2910 N. Maple, Franklin Park, both of Ill. 60131

[ * ] Notice: The term of this patent shall not extend beyond the expiration date of Pat. No. 5,346,219.

[21] Appl. No.: 453,178

[22] Filed: May 30, 1995

[51] Int. Cl.[6] ..... A63B 53/04

[52] U.S. Cl. ..... 473/252; 473/329; 473/341

[58] Field of Search ..... 273/167 R, 167 H, 273/167 F, 169, 167 D, 167 A, 164.1, 78, 168, 170, 171, 172, 173

[56] References Cited

U.S. PATENT DOCUMENTS

| | | | |
|---|---|---|---|
| D. 218,178 | 7/1970 | Solheim | 273/169 |
| 1,154,490 | 9/1915 | Davis | 273/78 |
| 3,042,405 | 7/1962 | Solheim | 273/168 |
| 3,220,733 | 11/1965 | Saleeby | 273/164.1 |
| 3,578,332 | 5/1971 | Caldwell | 273/167 F |
| 3,652,093 | 3/1972 | Reuter | 273/167 H |
| 3,851,877 | 12/1974 | Giambazi | 273/167 G |
| 3,909,005 | 9/1975 | Piszel | 273/80.1 |
| 3,923,308 | 12/1975 | Mills | 273/167 G |
| 3,955,819 | 5/1976 | Yokich | 273/164.1 |
| 4,979,744 | 12/1990 | Alcala | 273/169 |
| 5,346,219 | 9/1994 | Pehoski | 273/168 |

*Primary Examiner*—Sebastiano Passaniti
*Attorney, Agent, or Firm*—Leo J. Aubel

[57] ABSTRACT

A golf putter head formed from a solid material to to have a striking surface separated from the body member by a spacing formed parallel to the striking surface to thereby provide an improved putter.

2 Claims, 2 Drawing Sheets

Section A-A

Section B-B

MALLET AND BLADE PUTTER HEADS

BACKGROUND OF INVENTION

This invention is related to U.S. Pat. No. 5,346,219 issued to Richard J. Pehoski and Joseph A. Pessetti, the inventors of the present invention. The present invention is and improvement and modification the putter of U.S. Pat. No. 5,346,219.

Basic types of putters presently in use include the so-called blade putters as disclosed in said U.S. Pat. No. 5,346,219 and the mallet type putters which have a more massive and usually rounded body portion. The present invention discloses an improvement to both mallet and blade type putters.

SUMMARY OF INVENTION

A golf putter comprising a head formed from a solid or single piece of metal such as of titanium or brass material comprising an elongated rectangular bar member having a space between it and the body member. The bar member provides the ball striking surface. The golf putter shaft is inserted into the body member.

The foregoing features and advantages of the present invention will be apparent from the following more particular description of the invention. The accompanying drawings, listed hereinbelow, are useful in explaining the invention.

DRAWINGS

DESCRIPTION OF INVENTION

Figure 2:
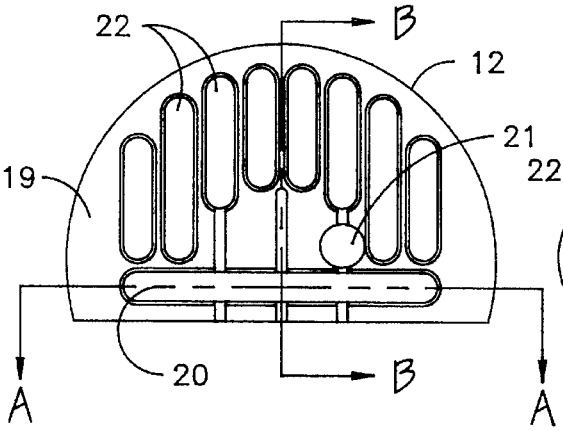
FIG. 2 is a top view of the putter head of FIG. 1.
Figure 1:
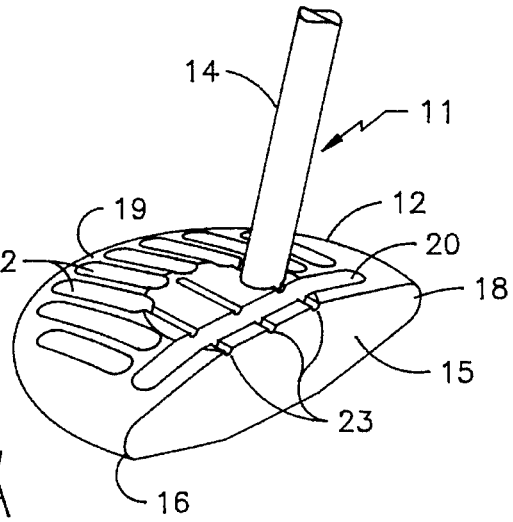
FIG. 1 is an isometric view of the inventive mallet type golf putter.

FIG. 1 is an isometric view of the putter 11 and putter head 12 of the invention. Putter head 12 is machined from a solid piece of material such as of brass, titanium or other suitable material. Head 12 is machined to form an elongated rectangular side member 15 extending between the toe 16 and heel 18 of the putter head 12. Side member 15 is spaced from rounded body (mallet) member 19 by rectangular spacing 20 formed parallel to the side member 15. The putter shaft 14 is received in a centered bore 21 (see FIG. 2) in the body member 19. A plurality of rectangular apertures generally labeled 22 are formed in the body member 19 in substantially normal orientation to spacing 20. Apertures 22 provide a means of reducing the weight of the mallet head.

Transverse alignment grooves (three in this embodiment) generally labeled 23 are formed on the top of body member 19 and side member 15. The alignment grooves assist the user in aligning the line or direction for striking the ball toward the hole.

Figure 3:
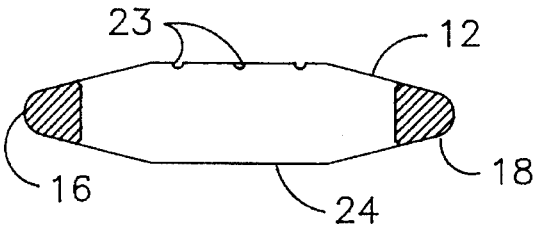
FIG. 3 is a view partially in section of the putter head of FIG. 2 taken along line A—A of FIG. 2.
Figure 4:
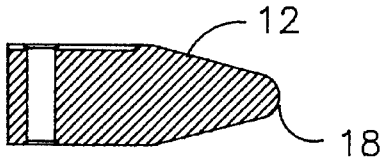
FIG. 4 is a view partially in section of the putter head of FIG. 2 taken along line B—B of FIG. 2.

The sole 24 of the putter head 12 (see FIG. 3) is angled upwardly at both the toe 16 and heel 18 of the putter head. The section drawings of FIGS. 3 and 4 assist in envisioning the structure of the putter head 12.

Figure 5:
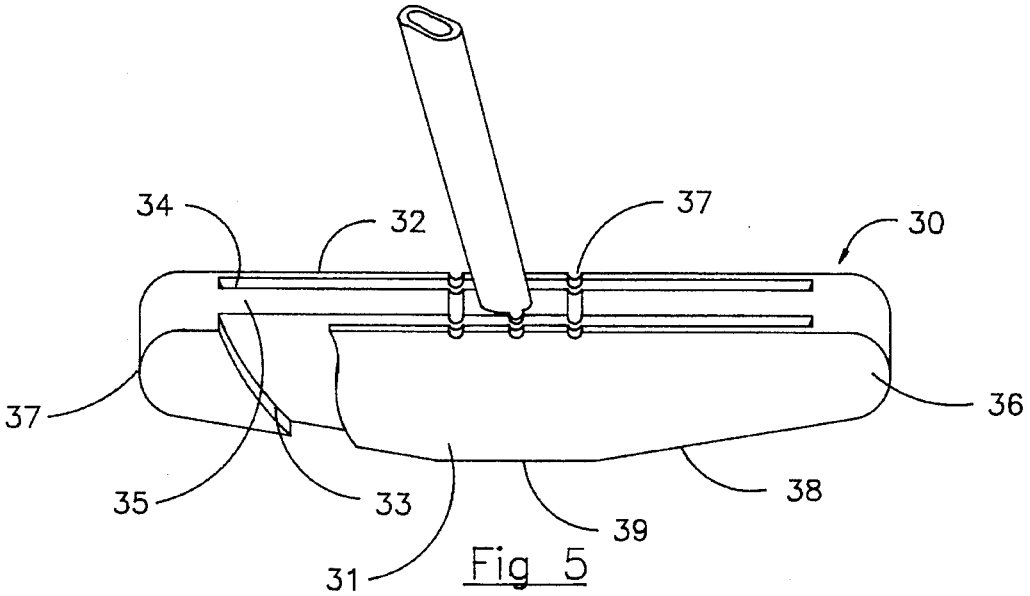
FIG. 5 is an isometric view of another embodiment of the inventive putter comprising a blade type putter.

A blade type putter head 30 is shown in FIG. 5. Putter head 30 includes side members 31 and 32 having spaces 33 and 34 between the side members and the central body section 35. The edges of the spacings 33 and 34 adjacent the toe 36 and heel 37 of the putter head 30 are curved upwardly. This feature provides a means of providing a better balance for the head 30, as well as making the spacing more easily manufacturable. The contour of the sole 38 of head 30 comprises a flat center section 39 and which is upwardly and symmetrically angled toward the toe 36 and heel 37 to provide a good balanced set or lie of the putter 11 on the green when it is in use. Grooves 37 of putter head 30 are similar in construction and function to grooves 23 of putter head 12.

Figure 6:
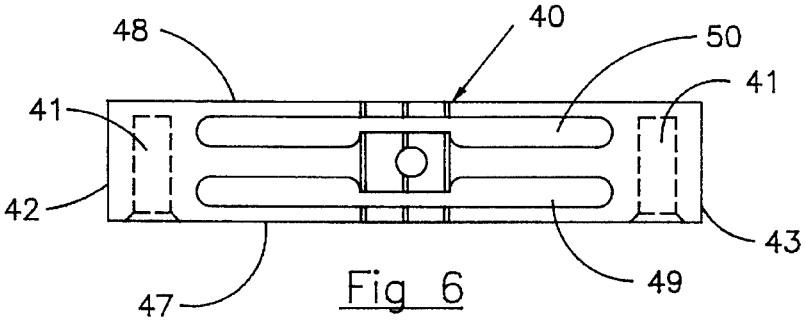
FIG. 6 is a third embodiment of the inventive putter head including weight reducing inserts.
Figure 7:
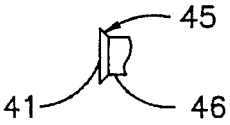
FIG. 7 is a side view of the insert for the putter head of FIG. 6.
Figure 8:
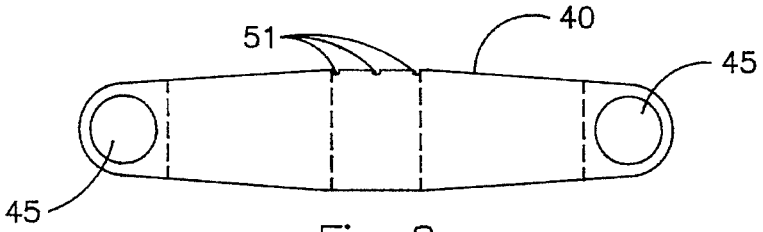
FIG. 8 is a side view of the putter head of FIG. 6 to emphasize the appearance of the putter head when the caps are made of different colored metal; and, FIG. 9 is a side view of another embodiment of the inventive putter head contoured to have a slimmer and more narrow appearance.

Another embodiment of the inventive putter head 40 is shown in FIGS. 6, 7 and 8. Putter head 40 includes side members 47 and 48 each spaced from a central body section by respective spacings 49 and 50. Putter head 40 includes a pair of blind cylindrical holes, generally labelled 41, formed in each of toe 42 and heel 43 of putter head 40. Holes 41 extend from the outer surface of side member 47, toward the opposite side member 48 and terminate at a point approximately the thickness of side member 48 from the opposite outer surface of head 40.

Apertures 41 provide a means of reducing the weight of the putter head 40 such as when a lighter weight putter is desired. The entrance or opening of apertures 41 is bevelled to better receive a respective bevelled insert or cap 45, shown in FIG. 6. Insert 45 comprises a circular top and a cylindrical rod 46 of a size to be press fit into the associated apertures 41. In assembly, a insert 45 is positioned and aligned with each apertures 41 and an insert is press fitted into each aperture. Next the surface of the caps 45 are ground and polished to be flush with the ball striking or outer surfaces of members 47 and 48. For aesthetic purposes the inserts 45 may be of a different color metal to contrast with the color of the side surfaces of side members 47 and 48, as indicated in FIG. 8.

Putter head 40 also includes aligning grooves 51 similar in construction and function as the grooves 23 of putters 12 head.

As described in U.S. Pat. No. 5,346,219, the spacing 20 of putter head 20, the spacing 49 and 50 of putter head 40, and the spacings 33 and 34 of putter head 30 all permit flexure of the respective side member when that side member strikes the golf ball. The striking member flexes slightly when the ball is struck off exact center in either direction, thereby correcting ball direction for producing a more accurate putt.

Figure 9:
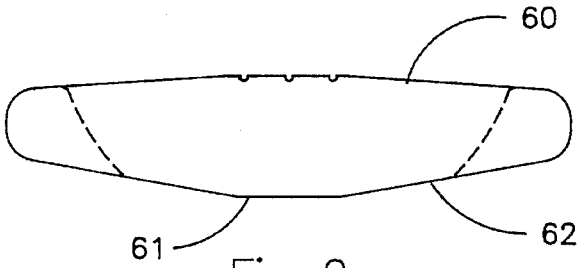

FIG. 9 is a side view of a putter head 60 which is another embodiment of the invention. As can be seen, the putter head 60 is somewhat more narrow or streamlined an lighter in weight than the putter heads 30 and 40. As shown in FIG. 9, the center flat section 61 of the sole 62 of head 60 is relatively small or limited and the toe and heel are symmetrically angled upwardly from flat section 61 to a greater degree than the other embodiments of the inventive putter heads. This provides a more open grounding or rest of the sole relative to the surface of the green.

While the invention has been particularly shown and described with reference to a preferred embodiment thereof, it will be understood by those skilled in the art, that various changes in form and detail can be made therein without departing from the spirit and scope of the invention.

We claim:

1. A mallet head for a golf putter device having a center body member of semi-cylindrical shape having a round portion and a flat portion, spaced elongated apertures formed through said putter head in a direction perpendicular to the flat portion of said center body member to provide a head of controlled weight, a rectangular shaped side member comprising a ball striking surface, a machined aperture formed parallel to said side member and said flat portion to provide a spacing between said side member and said center member, said side member providing flexure as said putter head strikes a ball which geometrically tends to cradle and guide the ball in the line directed, and alignment grooves formed on said center body member and said side member and transverse to said ball striking surface to provide an aligning reference for the user of said putter head.

2. A golf putter head having a center body member, a side member comprising a ball striking surface, a machined aperture forming a spacing between the center member and said side member, a pair of spaced machined apertures, the ends of said apertures forming symmetrical arcs curving downwardly and inwardly from the ends of the putter head to the center of the putter head, and said side member providing flexure upon striking a ball which tends to cradle and guide the ball in the line directed.

* * * * *